US005350892A

United States Patent [19]

Rozier

[11] Patent Number: 5,350,892

[45] Date of Patent: Sep. 27, 1994

[54] MEDIUM TENSION CIRCUIT-BREAKER FOR INDOOR OR OUTDOOR USE

[75] Inventor: Paul Rozier, Chalon sur Saone, France

[73] Assignee: GEC Alsthom SA, Paris, France

[21] Appl. No.: 977,785

[22] Filed: Nov. 17, 1992

[30] Foreign Application Priority Data

Nov. 20, 1991 [FR] France ..... 91 14312

[51] Int. Cl.[5] ..... H01H 33/42; H01H 33/52

[52] U.S. Cl. ..... 200/144 B; 200/145

[58] Field of Search ..... 200/144 R, 144 B, 145, 200/148 R, 148 D, 148 F, 150 J, 150 JA, 150 L, 50 R, 50 A, 50 AA, 334–339, 341–343, 345, 355, 376, 390–391, 430–432; 361/334–339, 341–343, 345, 355, 376, 390–391, 430–432

[56] References Cited

U.S. PATENT DOCUMENTS

| | | | |
|---|---|---|---|
| 2,492,490 | 12/1949 | Lindae | 200/50 |
| 3,864,534 | 2/1975 | Goodwin, Jr. et al. | 200/148 R |
| 3,970,809 | 7/1976 | Mitchell | 200/144 B |
| 4,038,585 | 7/1977 | Wolski et al. | 361/334 |
| 4,521,657 | 6/1985 | Thuries | 200/148 R |
| 4,568,804 | 2/1986 | Luehring | 200/144 B |
| 4,654,494 | 3/1987 | Wüthrich | 200/337 |
| 5,128,502 | 7/1992 | Hux | 200/145 |

*Primary Examiner*—A. D. Pellinen
*Assistant Examiner*—Michael A. Friedhofer
*Attorney, Agent, or Firm*—Sughrue, Mion, Zinn, Macpeak & Seas

[57] ABSTRACT

A multipole circuit-breaker for each pole has an insulating feedthrough including a cylindrical first portion containing a vacuum bottle. The vacuum bottle comprises an insulating case closed by first and second endplates. The first metal endplate carries a first terminal outside the case and a fixed contact inside the case. The second endplate has a moving metal rod passing therethrough in sealed manner and carries a moving contact. The second endplate is electrically connected to the second cylindrical portion having a metal tube disposed coaxially therein. The metal tube is mechanically connected to the vacuum bottle and is electrically connected to the moving rod. The tube comprises a drive rod connected to the moving metal rod. The insulating feedthroughs of each of the pole are connected to a common metal bar disposed substantially at the junction between the first and the second portions of each feedthrough. The bar contains a control shaft common to the poles and connected to a drive mechanism. The drive rod of each pole is mechanically connected to the shaft. The tube comprises an endpiece fixed thereto and constituting a second terminal.

20 Claims, 15 Drawing Sheets

MEDIUM TENSION CIRCUIT-BREAKER FOR INDOOR OR OUTDOOR USE

The present invention relates to a medium-tension circuit breaker (for up to 36 kV), suitable for indoor or outdoor use.

BACKGROUND OF THE INVENTION

Circuit breakers are known that use vacuum "bottles", in particular from the article by Eugene Maury entitled "Appareillage electrique d'interruption a haute tension" published in Techniques de l'Ingenieur, D 655-1, page 11.

Such a circuit-breaker comprises a large number of parts, and consequently it is relatively expensive. In addition, it is bulky. To sum up, in the architecture of prior art products, a vacuum bottle does not provide significant advantages.

An object of the present invention is to provide a vacuum bottle circuit-breaker that is of simple construction and consequently of moderate price, and that occupies a small volume.

Another object of the invention is to provide a circuit breaker capable of receiving a current sensor of simple structure.

SUMMARY OF THE INVENTION

The present invention provides a medium-tension circuit-breaker comprising one pole per phase, wherein each pole comprises an insulating feedthrough including a cylindrical first portion containing a vacuum bottle, said vacuum bottle comprising an insulating case closed by first and second metal endplates, the first metal endplate carrying a first terminal outside the case and a fixed contact inside the case, the second endplate having a moving metal rod passing therethrough in sealed manner and carrying a moving contact, the second endplate being electrically connected to said moving rod, the insulating feedthrough further including a second cylindrical portion having a metal tube disposed coaxially therein, which metal tube is mechanically connected to the vacuum bottle and is electrically connected to said moving rod, said tube containing a drive rod connected to said moving metal rod, the insulating feedthroughs of each of the poles being fixed to a common metal bar disposed substantially at the junction between the first and second portions of each feedthrough, said bar containing a control shaft common to the poles and connected to a drive mechanism, the control rod of each pole being mechanically connected to said shaft by means of a lever hinged on an endpiece that is secured to the metal tube, and an insulating arm having a first end hinged to said lever and having a second end hinged to a crank secured to said shaft, said endpiece being mechanically and electrically connected to said metal tube and constituting a second terminal of the pole.

The pole control shaft is a rotary shaft or a shaft that moves in translation along its own axis.

Advantageously, the first portion of said insulating feedthrough includes inside grooves that are parallel with the axis of the feedthrough and that co-operate with the outside wall of the vacuum bottle to define ventilation channels so that air flowing through said metal tube penetrates into said channels via holes in said tube.

In a particular embodiment, the vacuum bottle is placed in a cylindrical cage made of resin disposed inside said first portion of the feedthrough.

In which case, said resin cage includes inside grooves parallel to its axis and co-operating with the wall of the vacuum bottle to define ventilation channels, the air flowing in the metal tube penetrating into said channels via holes in said tube.

Advantageously, the dielectric strength between said metal tube and said second portion of the insulating feedthrough is provided by a sheath of insulating material slid over said metal tube and engaged in said second portion, assembly being facilitated by using an insulating grease.

Preferably, said sheath is made of latex.

In a particular embodiment, the moving parts between said control rod and said control shaft include a sprung backlash take-up mechanism.

In a variant, the end of the control rod includes a tubular end portion in which said moving rod is engaged, said moving rod having a slot in which a first pin is engaged that passes through said control rod, a spring bearing against a first thrust washer in contact with said end of the control rod, and against a second thrust washer engaged in the moving rod and held by a second pin that passes through the moving rod.

In a particular embodiment, the mechanical connection between said metal tube and the vacuum bottle, and the electrical connection between said metal tube and said moving contact rod are provided by means of a sleeve fixed to said second endplate, a ring secured to said sleeve and to said tube, and a ring or concertina-type contact disposed inside said ring and surrounding said moving contact rod.

In a variant, the moving rod is screwed to the drive rod, electrical contact between said moving rod and the metal tube being provided by means of a set of contact springs.

In a particular embodiment, the insulating case is molded over the metal tube.

Preferably, said endpiece comprises two half-collars clamped on said metal tube and in abutment against the end of said second portion of the insulating feedthrough.

According to an important feature of the invention, a coil having a toroidal metal core surrounds said second portion of the insulating feedthrough, level with the throat interconnected said first and second portions of the insulating feedthrough.

The invention also provides a medium-tension circuit breaker including at least one pole of the above-specified type.

BRIEF DESCRIPTION OF THE DRAWINGS

Embodiments of the invention are described by way of example with reference to the accompanying drawings, in which.

DETAILED DESCRIPTION

Figure 1:
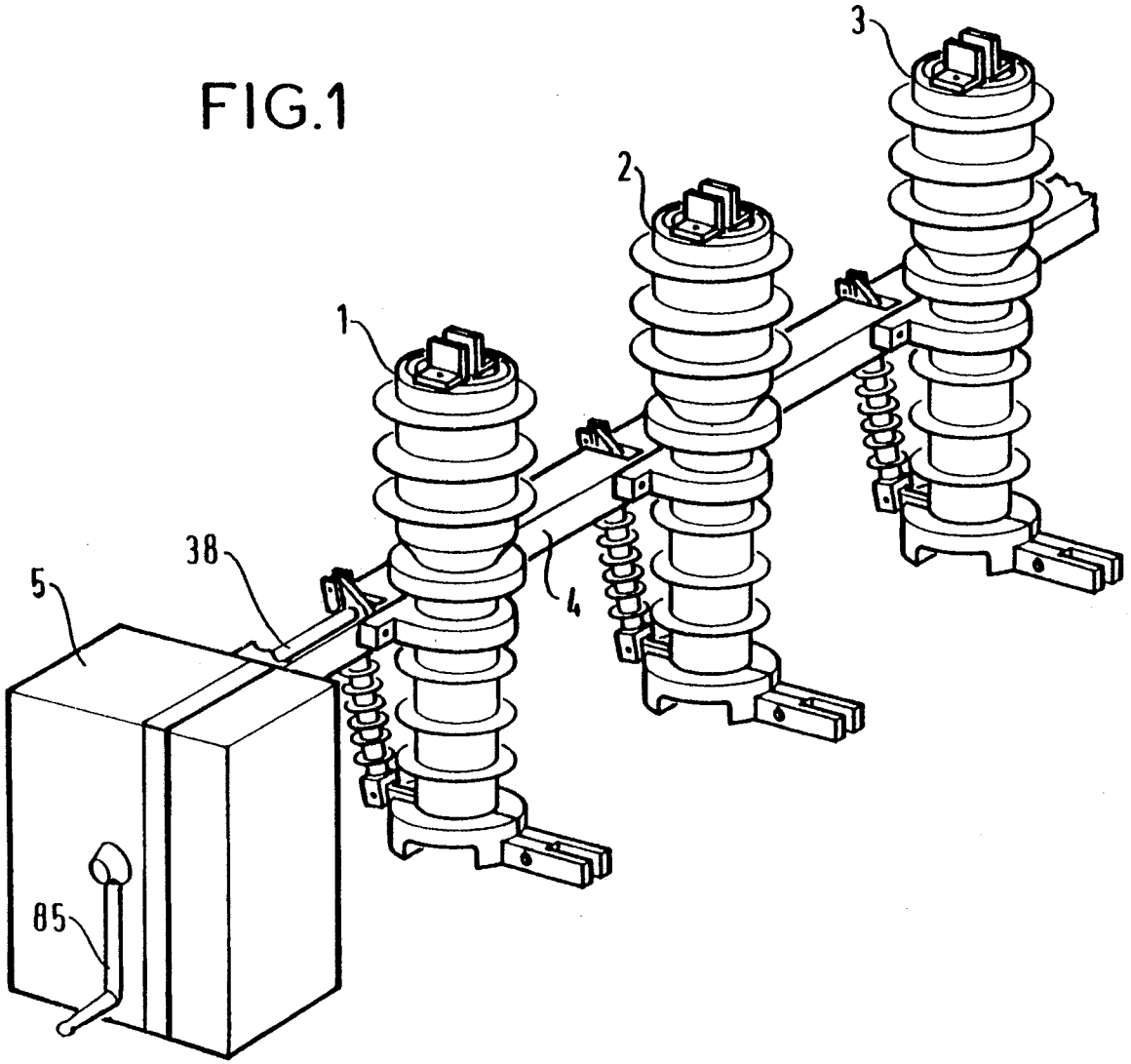
FIG. 1 is a perspective view of a three-phase circuit-breaker of the invention.

FIG. 1 is a perspective view of a three-phase circuit breaker of the invention.

The poles of the circuit-breaker are referenced 1, 2, and 3. They are mounted on a common bar 4 which serves as a support, but which is hollow so as to enable it to contain a control shaft 38 for the poles.

The control shaft terminates in a control box which is secured to the bar.

Figure 2:
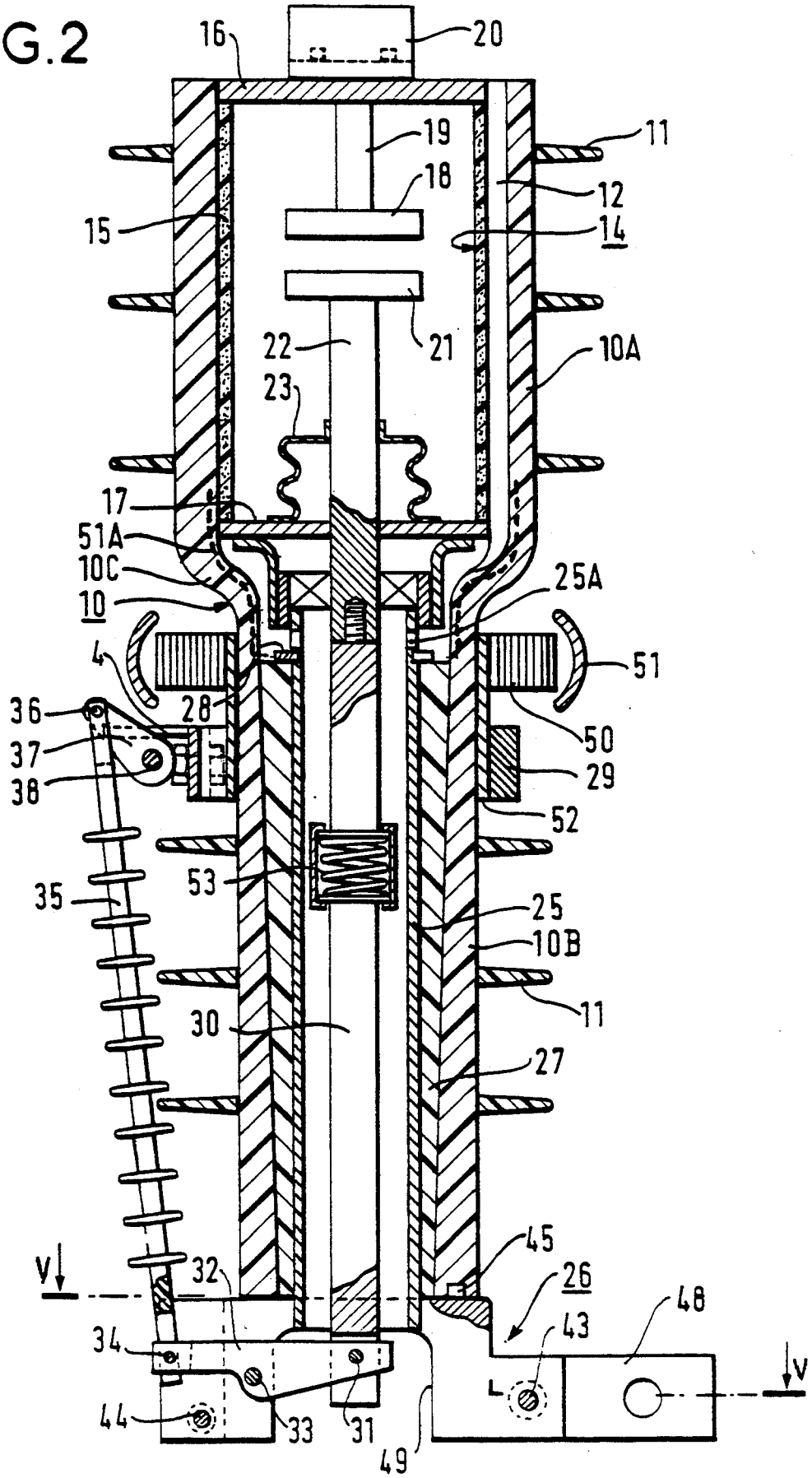
FIG. 2 is an axial section view through one pole of the circuit-breaker of the invention.

FIG. 2 is an axial section view through one pole, e.g. the pole 1. Naturally the poles are completely identical and interchangeable.

The pole comprises an insulating feedthrough 10 made of resin or of elastometer and provided with fins 11. In one particular embodiment, the fins are add-ons, in a variant they are integrally molded with the feedthrough.

A first portion 10A of the feedthrough is tubular in shape and contains a vacuum "bottle" 14 that is shown diagrammatically.

The vacuum bottle comprises an insulating case preferably made of ceramic, and two metal endplates 16 and 17. A rod 19 carrying a fixed contact 18 is secured to one side of the plate 16 whose other side is secured to a first terminal 20 of the pole.

The vacuum bottle includes a moving contact 21 carried by a rod 22 that slides through the plate 17 in sealed manner because of a sealing bellows 23.

The inside surface of the portion 10A of the feedthrough is provided with grooves 12 parallel to the axis of the feedthrough and serving as ventilation channels, as explained below.

Figure 3:
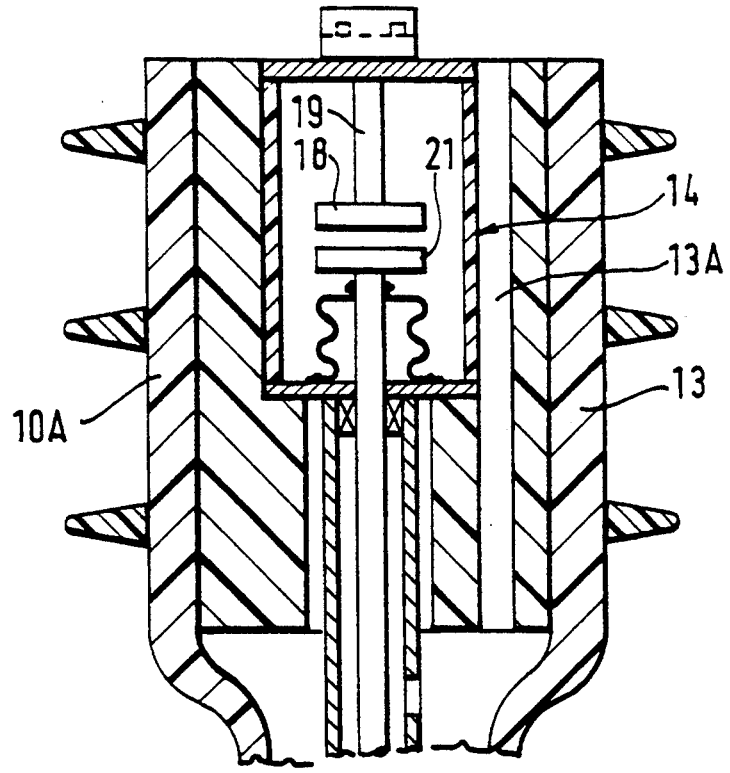
FIG. 3 is a fragmentary section view through one pole of a variant embodiment.

It may be observed that the dimensions of the portion 10A of the feedthrough, and in particular its inside diameter, are preferably selected to enable vacuum bottles of the largest sizes to be received. If a smaller bottle is to be received, then a cylindrical cage 13 of insulating material such as resin is interposed between the inside of the feedthrough 10A and the vacuum bottle 14, as shown in FIG. 3. The cage 13 is provided with inside grooves 13A that co-operate with the side surface of the vacuum bottle to define ventilation channels.

Returning to FIG. 2, it can be seen that the insulating feedthrough 10 includes a second portion 10B which is also tubular but of smaller diameter than the portion 10A, and which is connected thereto via a throat 10C. The inside surface of the portion 10B is conical, with the thickness of the feedthrough wall increasing progressively going away from the throat 10C. Naturally, the portions 10A and 10B constitute a single integrally-molded part.

The tubular portion 10B contains a metal tube 25 preferably made of copper and secured to the vacuum bottle as described with reference to FIG. 5, and in electrical contact with the moving rod 22 of the vacuum bottle. The tube 25 serves to convey current between the vacuum bottle and a part of complex shape 26 that serves, in particular, as the second terminal of the pole.

Dielectric strength is provided between the feedthrough 10B and the metal tube 25 by means of a sheath 27 made of an insulating material such as latex, and generally in the form of a tube having a cylindrical inside surface and a conical outside surface that is complementary to the inside surface of the portion 10B of the insulating feedthrough. On assembly, the sheath is slid over the metal rod 25, with sliding being facilitated by using an insulating grease, e.g. based on silicone. The outside surface of the sheath is then coated with the same grease and is engaged in the portion 10B of the insulating feedthrough with pressure being exerted so as to ensure that air is eliminated. The sheath is maintained under compression by stop means such as a spring clip 28 engaged in a groove in the tube 25.

The apparatus is fixed to the bar 4 by means of a fixing collar 29.

Opening or closing drive for the vacuum bottle is provided by means of a rod 30, e.g. made of metal, sliding inside the tube 25 and attached to the rod 22. The rod is hinged at 31 to a rocker lever 32 that is pivoted at 33 on the part 26. The other end of the lever 32 is hinged at 34 to a first end of an insulating rod 35 whose second end is hinged at 36 to a first end of a crank 37 whose second end is secured to the control shaft 38 placed in the bar 4.

In the vicinity of the plate 17, the copper tube has holes 25A for a function that is explained below.

When carrying nominal current, the vacuum bottle is heated up by the Joule effect. The bottle is cooled by air flowing through the part 26, through the annular space between the drive rod and tube 25, through the holes 25A, and into the grooves 12 of the portion 10A of the feedthrough.

Figure 4:
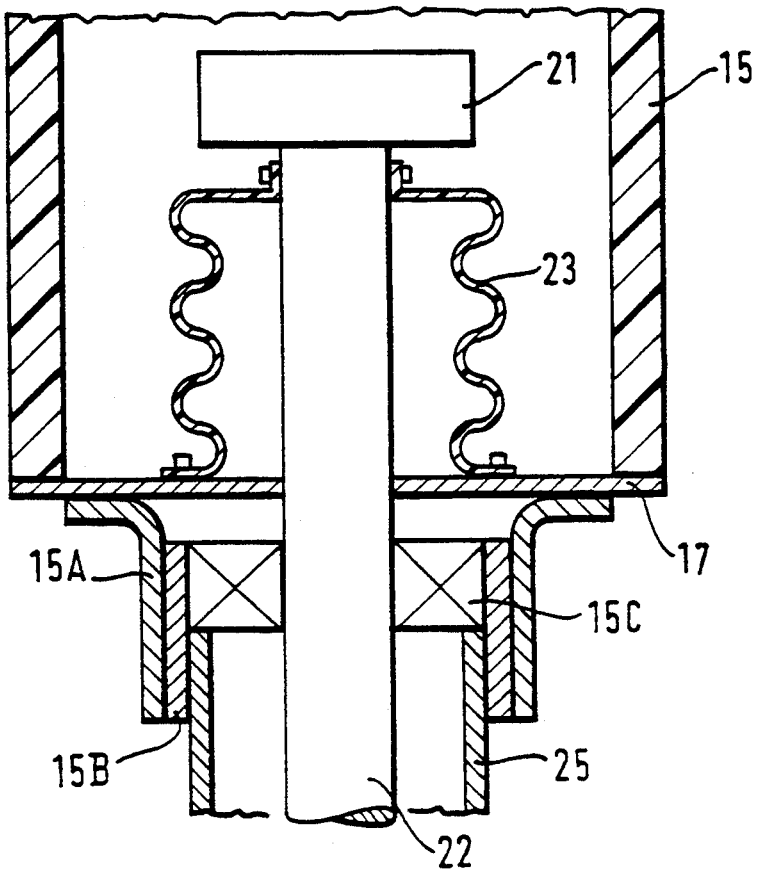
FIG. 4 is on a larger scale and shows dispositions for mechanically and electrically connecting the metal tube to the vacuum "bottle"

Reference is made to FIG. 4 which shows how the metal tube 25 is mechanically fixed to the vacuum bottle 14 and how current can pass from the moving rod 22 to the tube 25.

Vacuum bottles generally include a metal cap welded to the plate 17 and containing a bearing for the rod 22. For the purposes of the invention, the cap is changed and transformed into a sleeve 15A having an inside thread suitable for receiving a metal ring 15B. The tube 25 is engaged inside said ring and is secured to the ring by brazing or by screwing. The ring and the tube then define a shoulder having a concertina-type contact or a contact thimble 15C pressing thereagainst.

Figure 5:
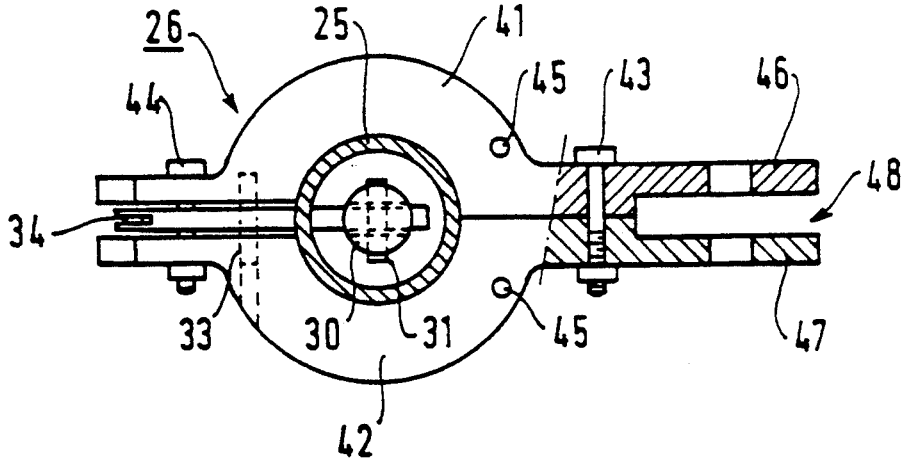
FIG. 5 is a section view on line V—V of FIG. 2.

The shape and the function of the part 26 are specified with reference to FIG. 5. It can be seen that the part 26 comprises two half-collars 41 and 42 capable of being clamped together by means of screws 43 and 44. These collars are clamped onto the end of the conductive tube 25 with contact pressure that is sufficient to ensure good current flow. The half-collars come into abutment against the end of the feedthrough 10B, thereby preventing the tube 25 and the vacuum bottle 14 which is connected thereto from moving in translation.

Studs 45 carried by the half-collars co-operate with recesses at the end of the feedthrough 10B to prevent the tube 25, and consequently the vacuum bottle 14, from rotating.

Two of the half-collar lugs 46 and 47 extend to constitute the second terminal 48 of the pole.

The screw 44 clamps the hinge 33 for the rocker lever 32.

The collars are notched at 49 to leave room for the hinge 31.

Finally, the pole includes a current sensor 50 in the form of a coil having a toroidal magnetic circuit. If the fins are add-ons, then the toroidal coil can be closed and can slide over the feedthrough 10B before the fins 11 are installed. If the fins are integrally molded with the feedthrough, then the magnetic circuit is of the open type.

The current sensors provided on the poles serve to detect an abnormal overload or short circuit current passing through the poles, thereby causing the circuit-breaker to be opened. The direct action maximum current relay that does not require any auxiliary energy source to be provided may be placed in the control box 5. In the event of the feedthrough breaking down level with the metal bar, the current sensor detects the ground fault and triggers disengagement.

The outside of the feedthrough level with the torus 50 and the support collar 29 on the bar 4 is coated with metal plating to equalize potential, namely ground potential.

The torus may be fitted with an anti-corona cap 51 held in place by conventional means (not shown).

FIG. 2 shows that there is a volume full of air present between the endplate 17 and the intermediate portion 10C of the feedthrough. Unless special precautions are taken, this volume could be subjected to a high potential gradient which could give rise to partial discharges that can be destructive in the long run. To avoid this drawback, the feedthrough includes a metal grid 51A level with said volume and integrally molded in the feedthrough, which grid is put to the same potential as the metal tube 25. As a result, the single voltage is applied to the sole insulating portion.

The drive rod 30 may include a backlash take-up member comprising a cage fitted with a spring 53. In a variant, this backlash take-up member may be disposed at any convenient location in the chain of moving parts connecting the rod 22 to the control shaft 38 located in the bar 4.

Figure 5A:
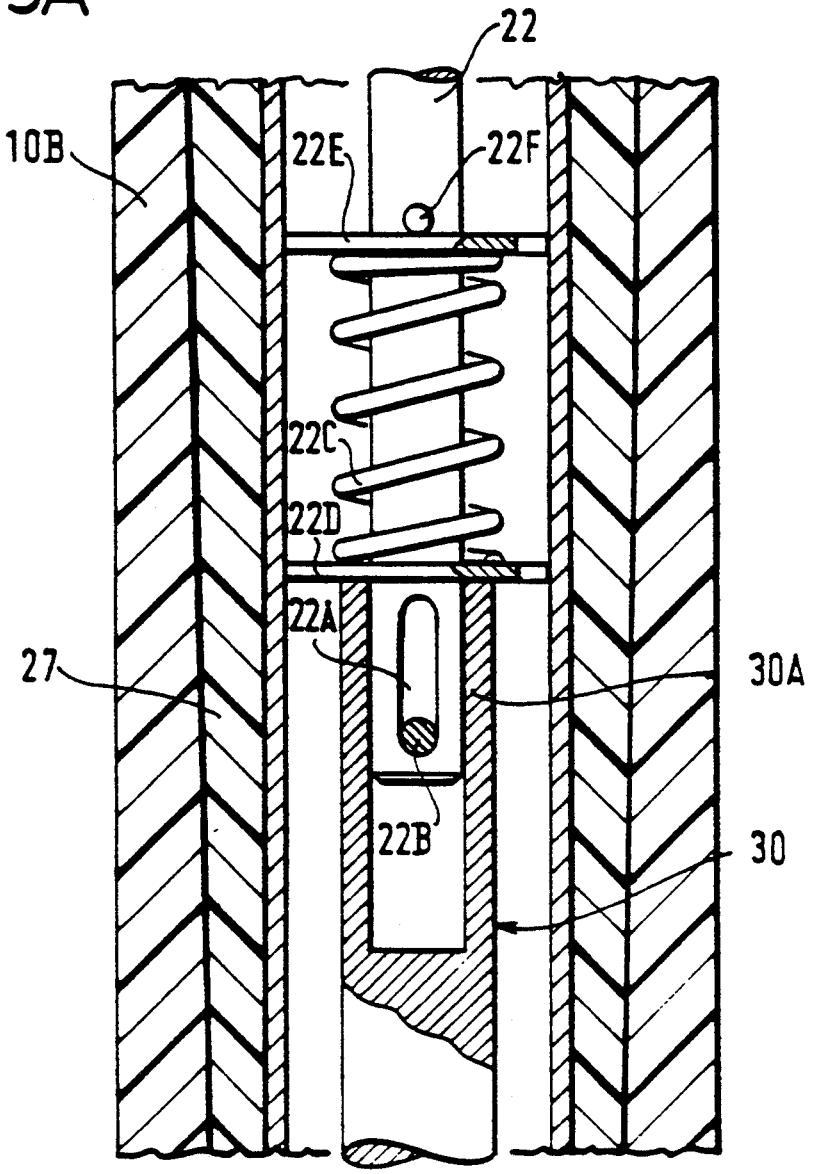
FIG. 5A is an elevation view in section of a backlash take-up device for controlling the contacts of the bottle.

Since the cage may be too bulky under some circumstances to be located inside the metal tube 25, it may be replaced by the device described below with reference to FIG. 5A.

At least the end of the control rod has a tubular portion 30A in which the end of the moving rod 22 of the bottle is engaged. The metal rod 22 has a slot 22A which receives a first pin 22B passing through the rod 30. A spring 22C is disposed between a first thrust washer 22D in contact with the end of the tubular portion 30A and a second washer 22E engaged in the rod 22 and retained by a second pin 22F passing through the rod 22. In the position where the contacts of the bottle are closed, the rod 30 compresses the spring 22C which transmits force without slack to the moving rod 22. On opening, the rod 30 pulls the rod 22. It may be observed that the backlash take-up assembly is guided in the conductive tube 25 by the thrust washers 22D and 22E of the spring. The washers have holes or notches in their peripheries for allowing a flow of cooling air to pass over the bottle.

It is said above that only the end of the control rod is made in the form of a tube. In a variant, the control rod may be in the form of a tube over its entire length.

Figure 5B:
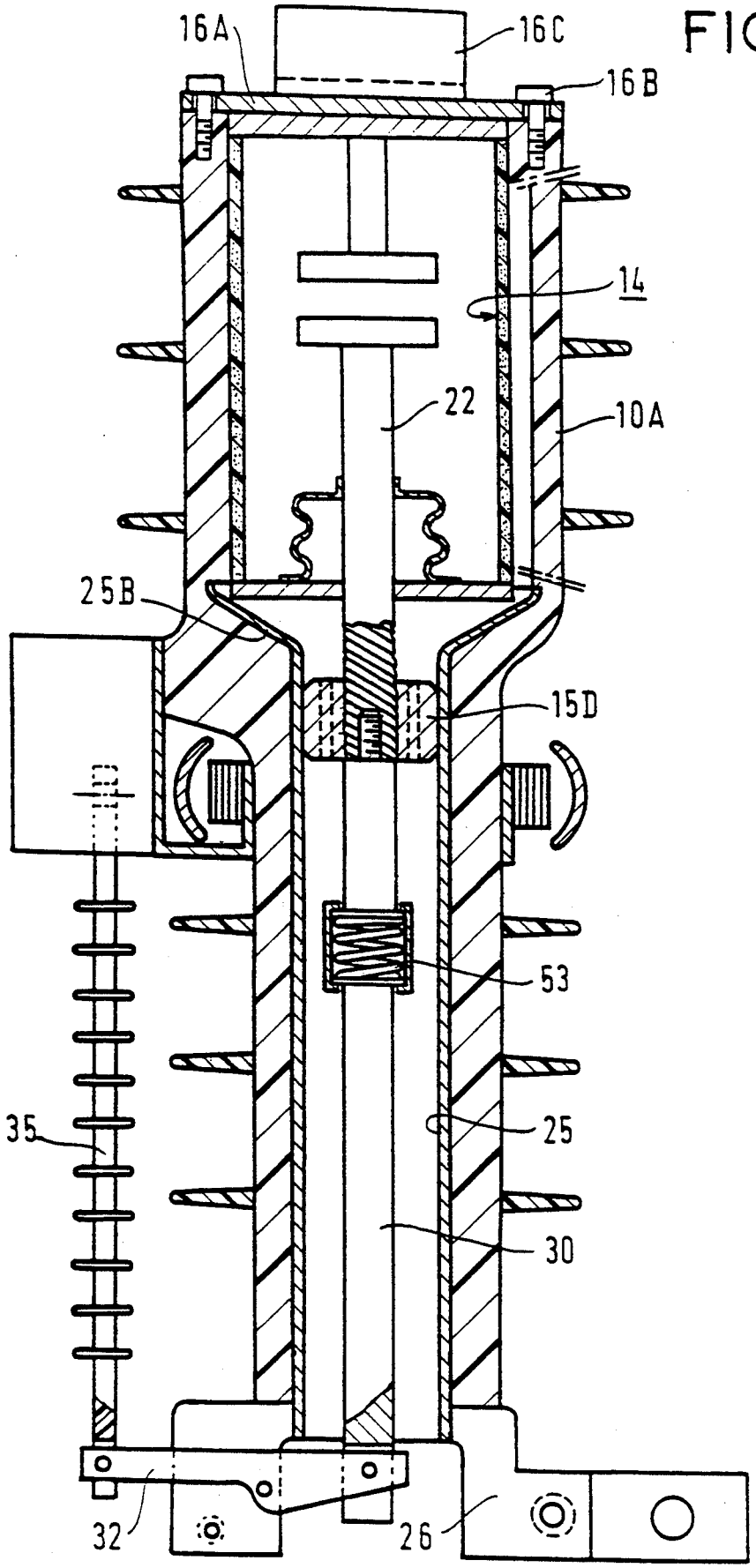
FIG. 5B is an elevation view of a pole in a variant embodiment of the invention.

FIG. 5B is an elevation view in axial section showing a pole constituting a variant embodiment of the invention. Items that are common to FIGS. 2 and 5B are given the same reference numerals. The copper tube 25 has a top portion 25B which is enlarged by spinning so as to constitute the bottom portion of the housing for the vacuum bottle. The drive rod 30 is directly screwed to the moving contact 21 of the vacuum bottle. Electrical connection between the rod 22 of the vacuum bottle and the tube 25 is provided by contact springs 15D. The top of the portion 10A of the feedthrough is closed by a plate 16A screwed down by screws 16B that co-operate with inserts molded in the insulating feedthrough. The plate 16A carries plates 16C that constitute both an electrical contact and a heat sink for the vacuum bottle.

When the insulating feedthrough 10 is molded, the tube 25 is placed as an insert therein and is thus accurately positioned relative to the insulating material.

Figure 5C:
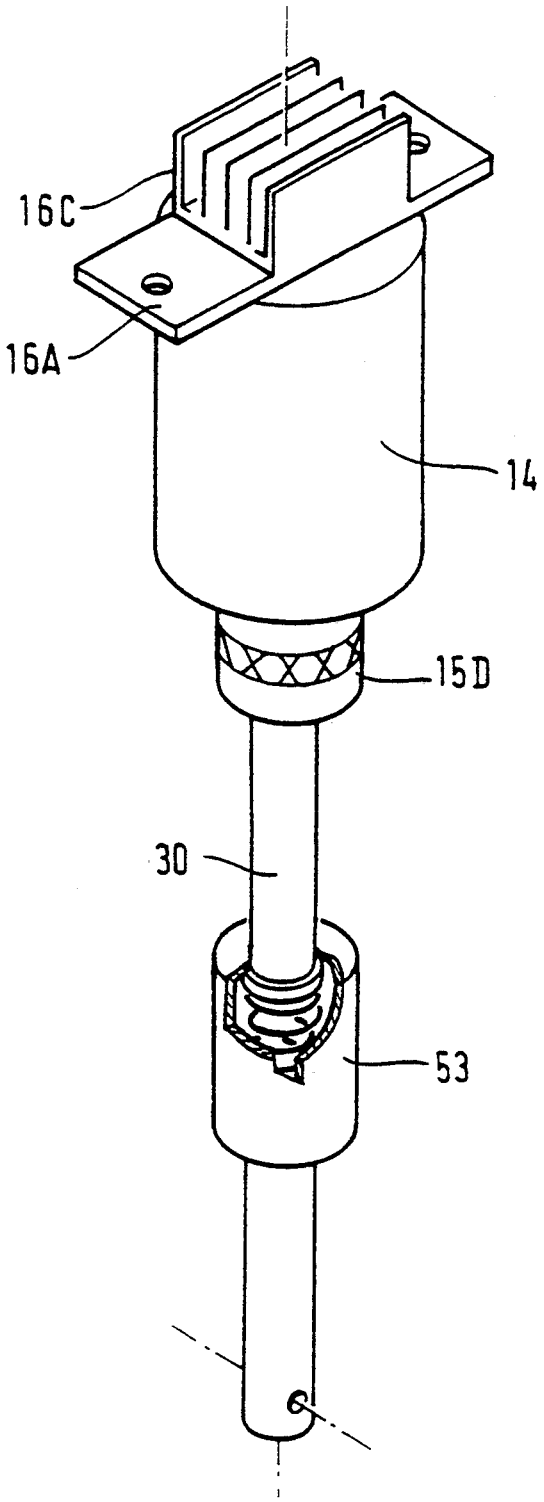
FIG. 5C shows the implementation of a "torch" when assembling a pole of the isolating circuit-breaker.

To assemble a pole, it is necessary to begin my making a "torch" as shown in FIG. 5C, comprising a vacuum bottle 14, its drive rod 30 screwed to the moving contact of the vacuum bottle, the set of contact springs 15D, the backlash take-up device 53, and the closure plate 16A. This torch is then inserted into the insulating case 10. It then suffices to install the part 26, the lever 32, and the insulating rod 35.

Figure 5D:
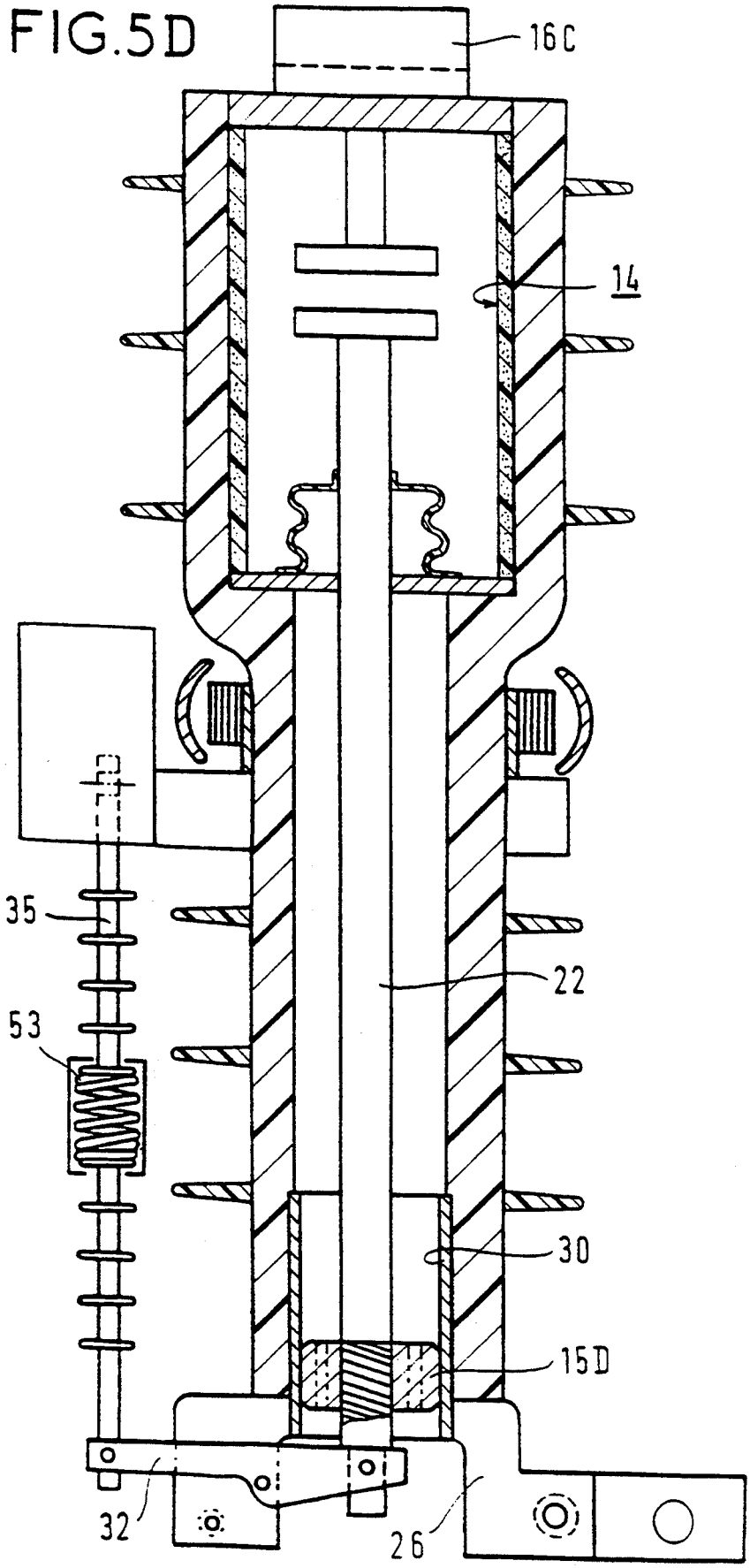

FIG. 5D shows a variant embodiment. Items that are common to FIG. 5D and to FIGS. 2 and 5B are given the same reference numerals.

The copper tube 30 is short and is placed at the bottom of the portion 10B of the insulating feedthrough. It co-operates with a set of contact springs 15D placed directly on the moving rod 22 of the vacuum bottle, which rod is of adequate length. The backlash take-up device 53 is now located on the insulating rod 35.

Figure 6:
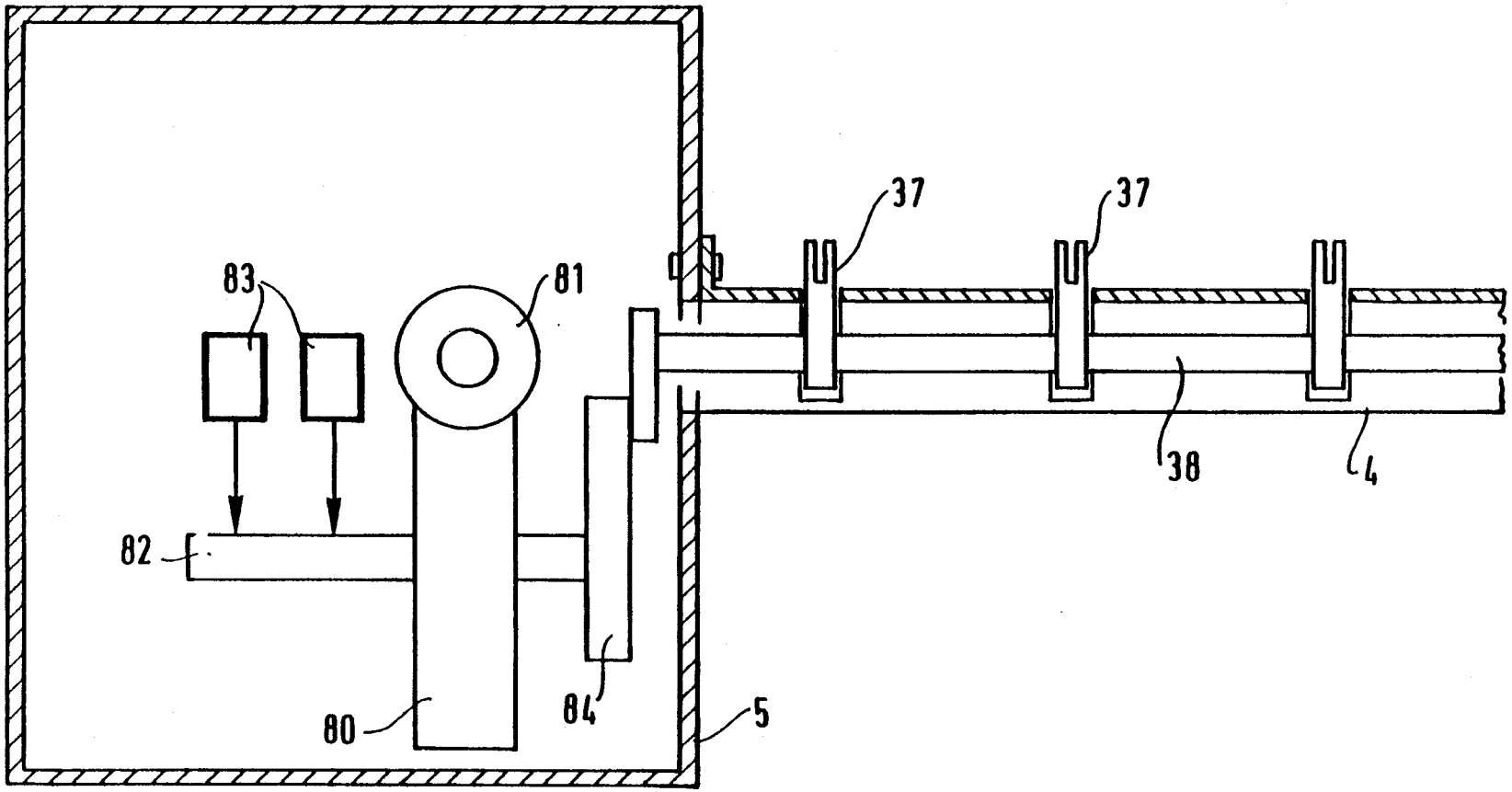
FIG. 6 is a diagram for explaining the control mechanism of the circuit-breaker.

In addition to the maximum current relay mentioned above, the control box 5 contains the mechanism for rotating the control shaft 38, enabling translation motion to be communicated to the rod 30 for the purpose of performing opening and closing cycles with the vacuum bottle. FIG. 6 is a diagram showing how this mechanism can be implemented, which mechanism has the advantage of being directly linked to the control shaft 38 of the circuit-breaker. It is necessary only to describe the principle of the mechanism since implementation thereof is within the competence of the person skilled in the art who may usefully make reference to the article by Eugene Maury entitled "Appareillage electrique d'interruption a haute tension" published in Techniques de l'Ingenieur, D 657-4, page 49.

FIG. 6 shows the shaft 38 disposed inside the bar 4 connected to the control box.

The mechanism comprises a drum 80 fitted with a spring which constitutes a store of drive energy. A motor and stepdown gear box unit 81 serves to drive the drum so as to store energy in the spring. The drum rotates a shaft 82 which always rotates in the same direction when the spring relaxes. This shaft is associated with coupling devices 83 under electrical or manual control and enabling the usual opening and closing cycles to be performed (e.g. a cycle: open, 0.1 s, close, open). An eccentric 84 serves to transform the one-way rotation of the shaft 82 into back-and-forth circular motion which is communicated to the control shaft 38 for the poles of the circuit-breaker.

In well known manner, the mechanism includes a manual resetting mechanism including a lever 85 that can be seen in FIG. 1.

Figure 6A:
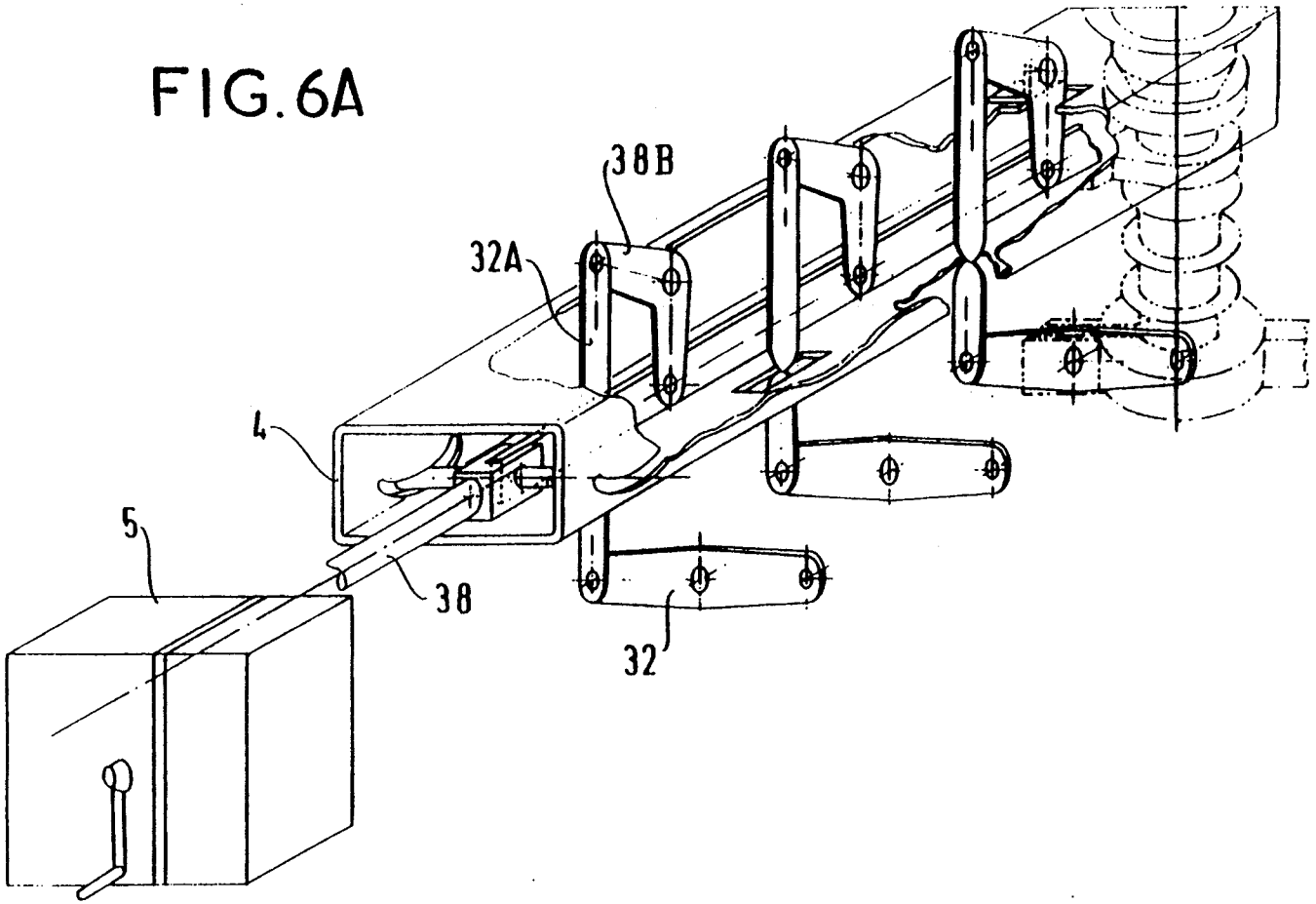
FIG. 6A is a perspective view of a variant embodiment of the means for driving the vacuum bottles of the poles.

From the above, it can be seen that the vacuum bottles are driven by rotating the control shaft 38. FIG. 6A shows a variant embodiment in which the shaft 38 is driven in translation, also known as "push-pull" drive. This motion is communicated to the lever 32 in conventional manner, e.g. by means of a lever 32A and a crank 38B.

The invention is typically applicable to making a medium-tension circuit-breaker, capable of operating at a nominal voltage of 36 kV and a nominal current of 1250 A.

Figure 7:
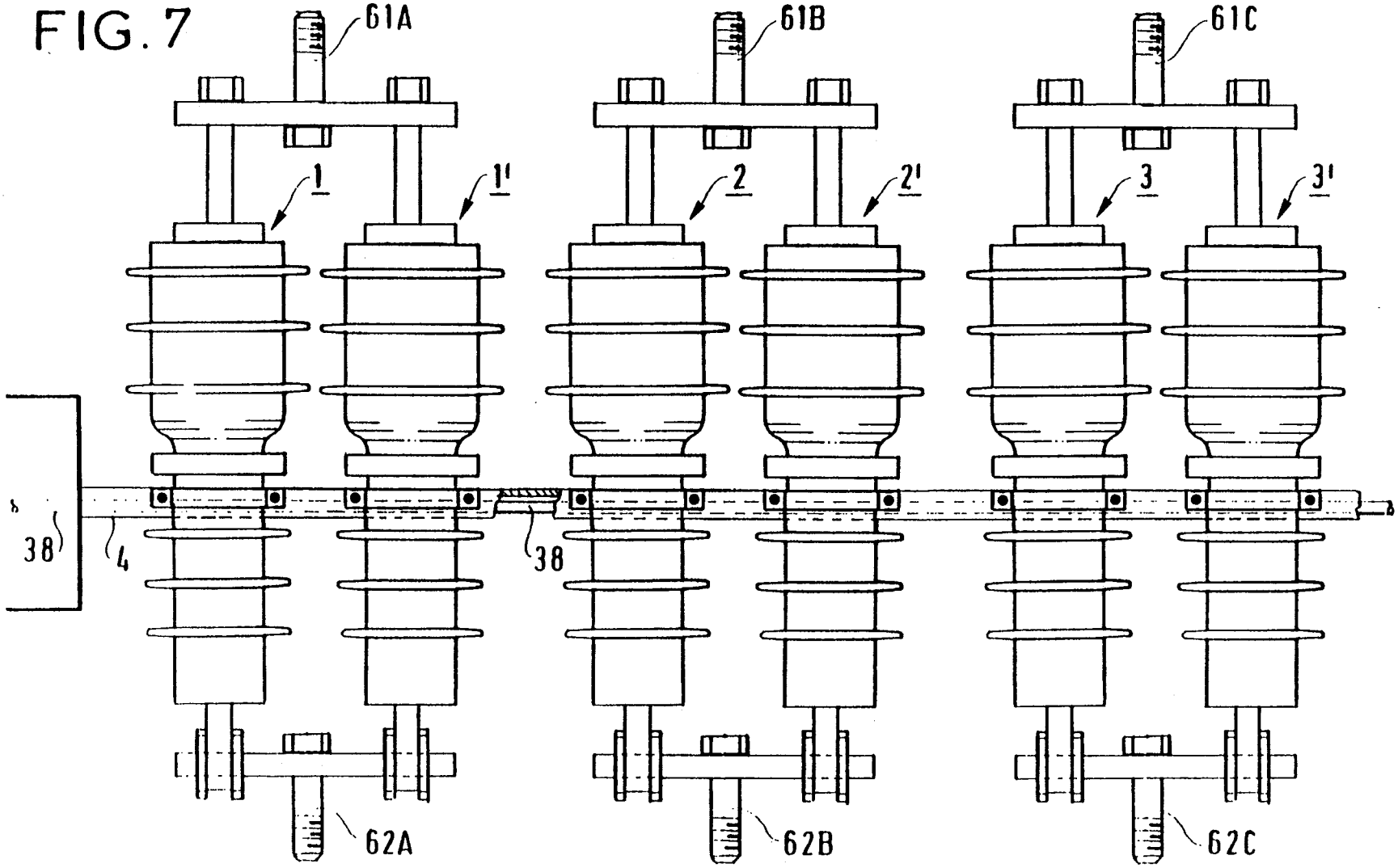
FIG. 7 is a diagram of a circuit-breaker using two poles in parallel per phase to double its nominal current.

It is possible to double the value of the nominal current by using pairs of poles connected in parallel, as shown in FIG. 7.

FIG. 7 shows pairs of poles, 1,1'; 2,2'; and 3,3' disposed on a common bar 4 using the same control shaft 38 and the same control box 5.

The ends of the poles are connected together in pairs to constitute terminals 61A, 61B, 61C and 62A, 62B, 62C.

Such a circuit-breaker can operate at a nominal voltage of 36 kV and a nominal current of 2500 A. Naturally, the circuit-breaker of the invention covers the entire range of medium-tension circuit-breakers, i.e. 7.2 kV, 12 kV, 24 kV, and 36 kV.

The invention is applicable to making medium-tension circuit-breakers for indoor use or outdoor use.

Figure 8:
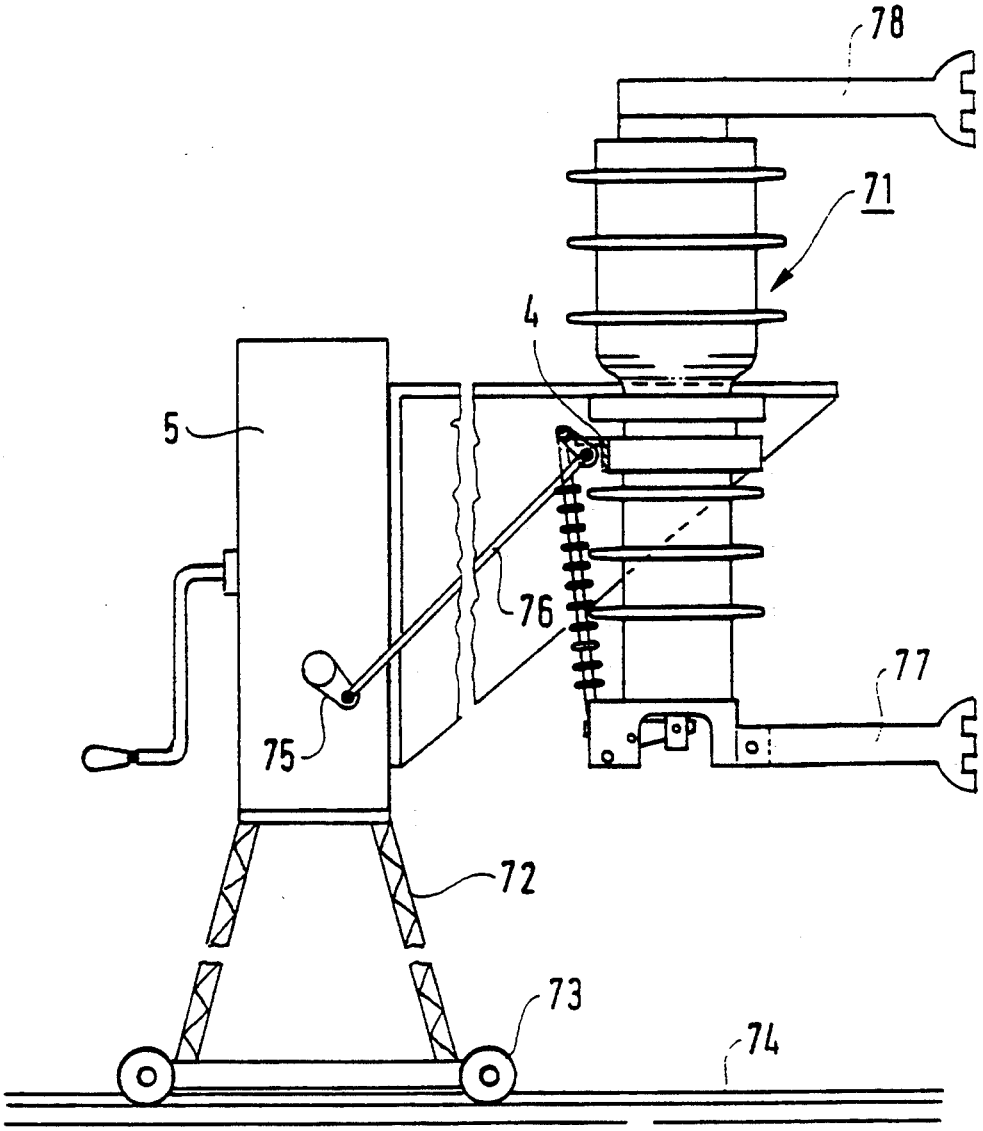
FIG. 8 is a diagrammatic elevation view of a medium-tension circuit-breaker that is unpluggable and that is designed for front coupling, the circuit-breaker being implemented using poles of the invention.

FIG. 8 shows an indoor type circuit-breaker having front coupling.

The circuit-breaker comprises three poles of the type described above. These poles are in alignment on a common support bar 4. Only the pole 71 is visible in FIG. 8, since FIG. 8 is a side view. A chassis 72 provided with wheels 73 suitable for running on rails 74 carries the bar 4 and the control box 5. The control mechanism includes a linkage that has a crank 75 and a connecting rod 76. The terminals of the poles are extended by pluggable connections 77 and 78.

The main use of a circuit-breaker of this type is in equipping prior art unpluggable bays which may be new or existing and in which it is desired to use vacuum bottles instead of apparatuses made of earlier technology (e.g. circuit-breakers using a small volume of oil). It may be observed that for indoor installations, the circuit-breaker is enclosed in a metal bay.

Figure 9:
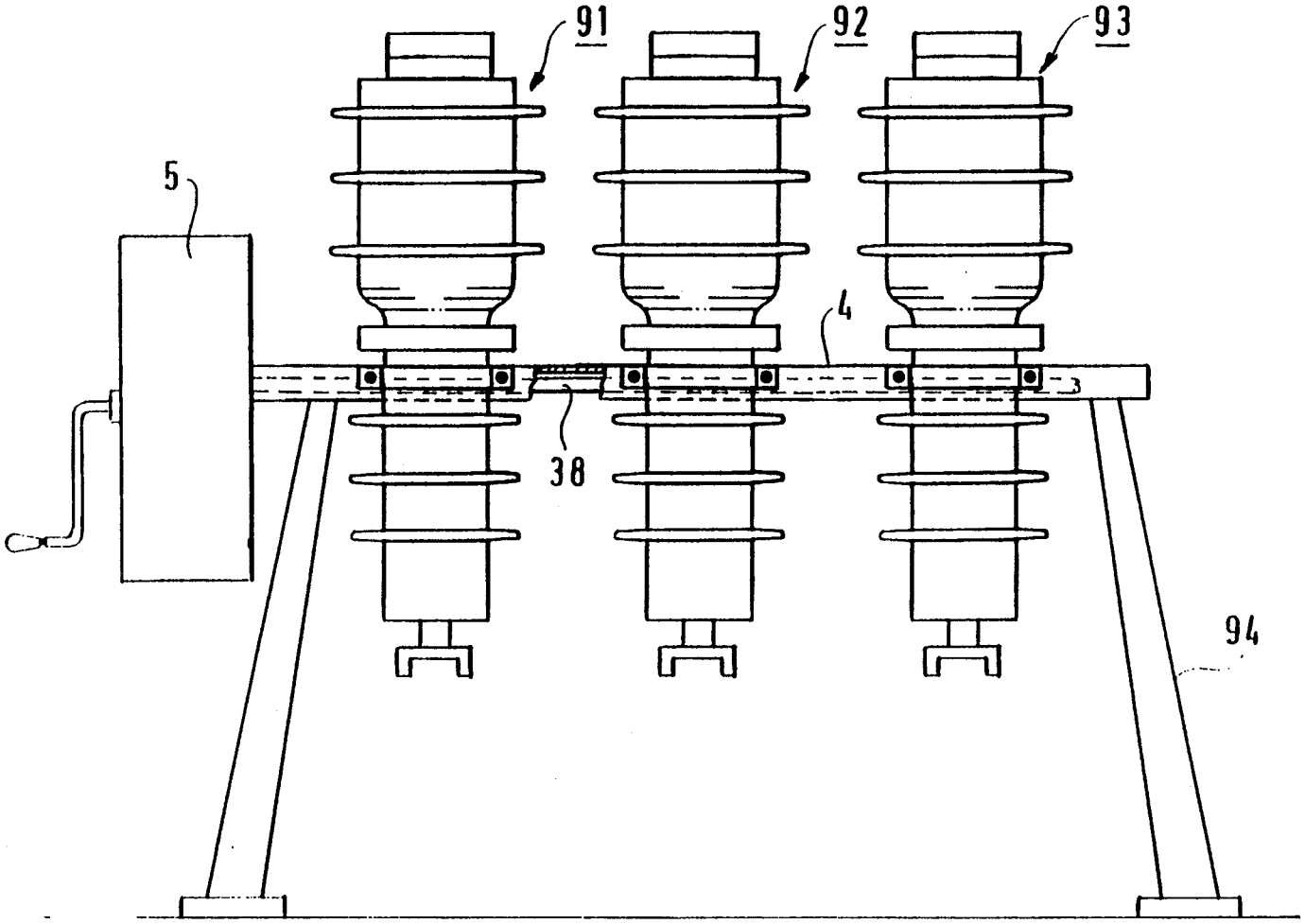
FIG. 9 is a diagrammatic elevation view of a medium-tension circuit-breaker for end-on coupling, implemented using poles of the invention.

FIG. 9 shows a circuit-breaker for end-on coupling. The support bar 4 can be seen together with three poles 91, 92, and 93 all supported by a metal chassis 94. The control box 5 is mounted perpendicularly to the support bar so that the pole control shaft 38 is directly engaged in the control mechanism. The main use of this type of circuit-breaker (designed for indoor use) is equipping stationary bays that are generally fitted with isolating section switches. The bays may either be old bays for renovation, or new bays in which it is desired to use vacuum bottles.

The invention is applicable to making circuit-breakers for outdoor use, providing the usual precautions are taken against the weather (using insulators that withstand pollution and ultraviolet radiation, protecting the poles against penetration by water or snow, galvanizing the chassis, tropicalizing the coils, etc. . . . ).

Figure 10:
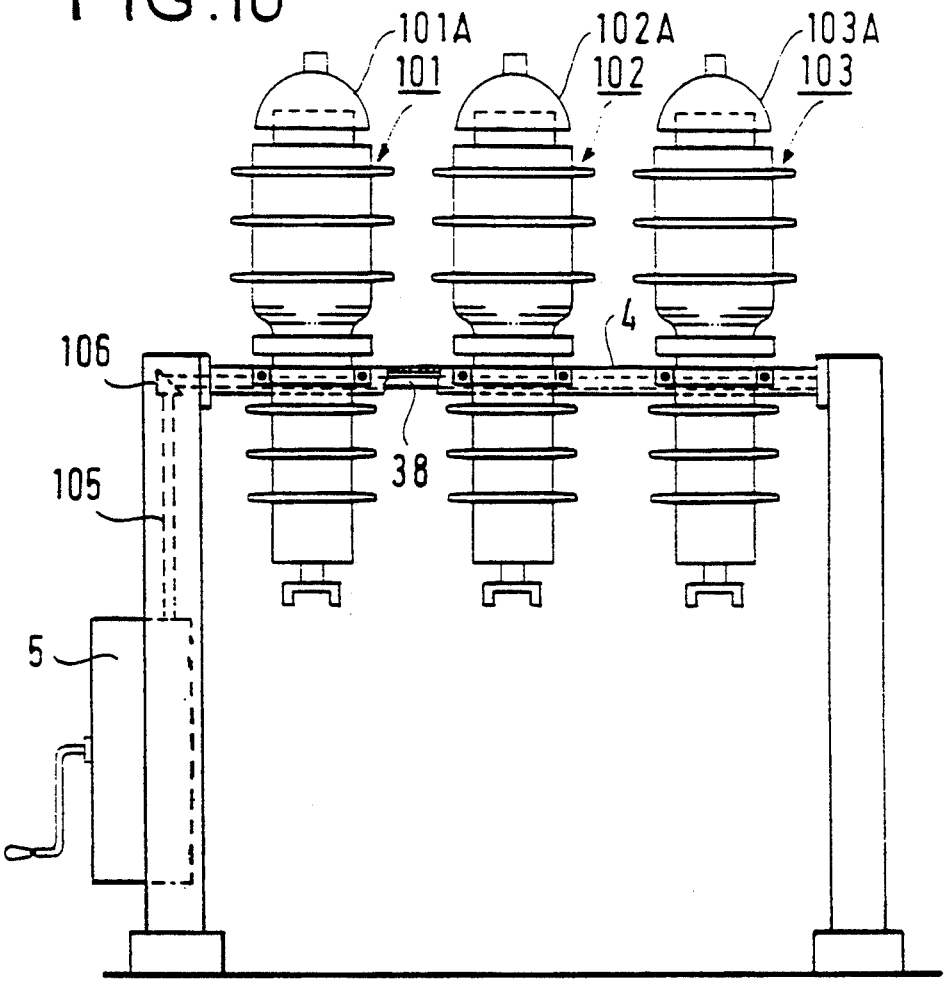
FIG. 10 is a diagrammatic elevation view of a medium-tension circuit-breaker for outdoor use and mounted on a gantry, the circuit-breaker comprising poles of the invention.

FIG. 10 shows a stationary type circuit-breaker with end-on coupling.

The bar 4 carrying the poles 101, 102, 103 is made of galvanized steel. The ground level control box 5 co-operates with a rod 105 and an angle take-off 106 to actuate the control shaft 38 which is disposed in the supporting bar.

The poles are provided with respective metal protective caps 101A, 102A, and 103A, which shelter the bottles from bad weather, and in particular which prevent rainwater penetrating therein, without preventing ventilation. The feedthroughs of the poles are advantageously made of cycloaliphatic epoxy resin.

Figure 11:
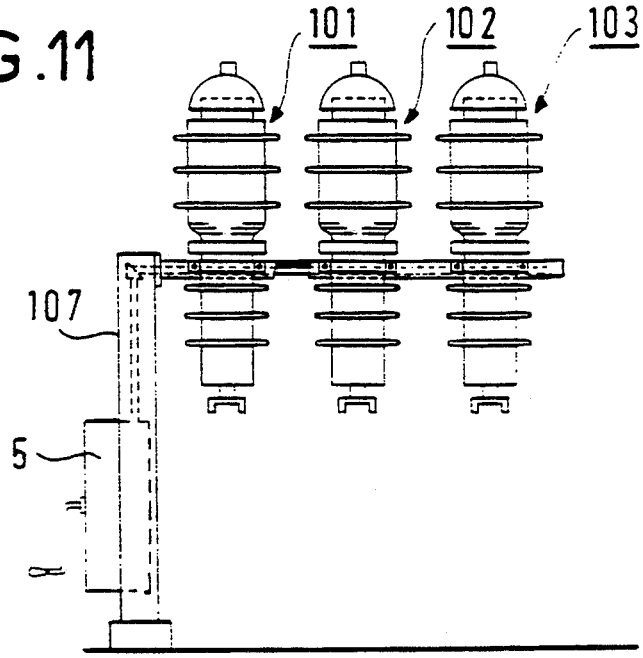
FIG. 11 is a diagrammatic elevation view of a medium tension circuit-breaker for outdoor use mounted on a bracket, implemented using poles of the invention.

In the variant embodiment shown in FIG. 11, the gantry is replaced by a single pylon 107 which co-operates with the bar 4 to constitute a bracket.

Figure 12:
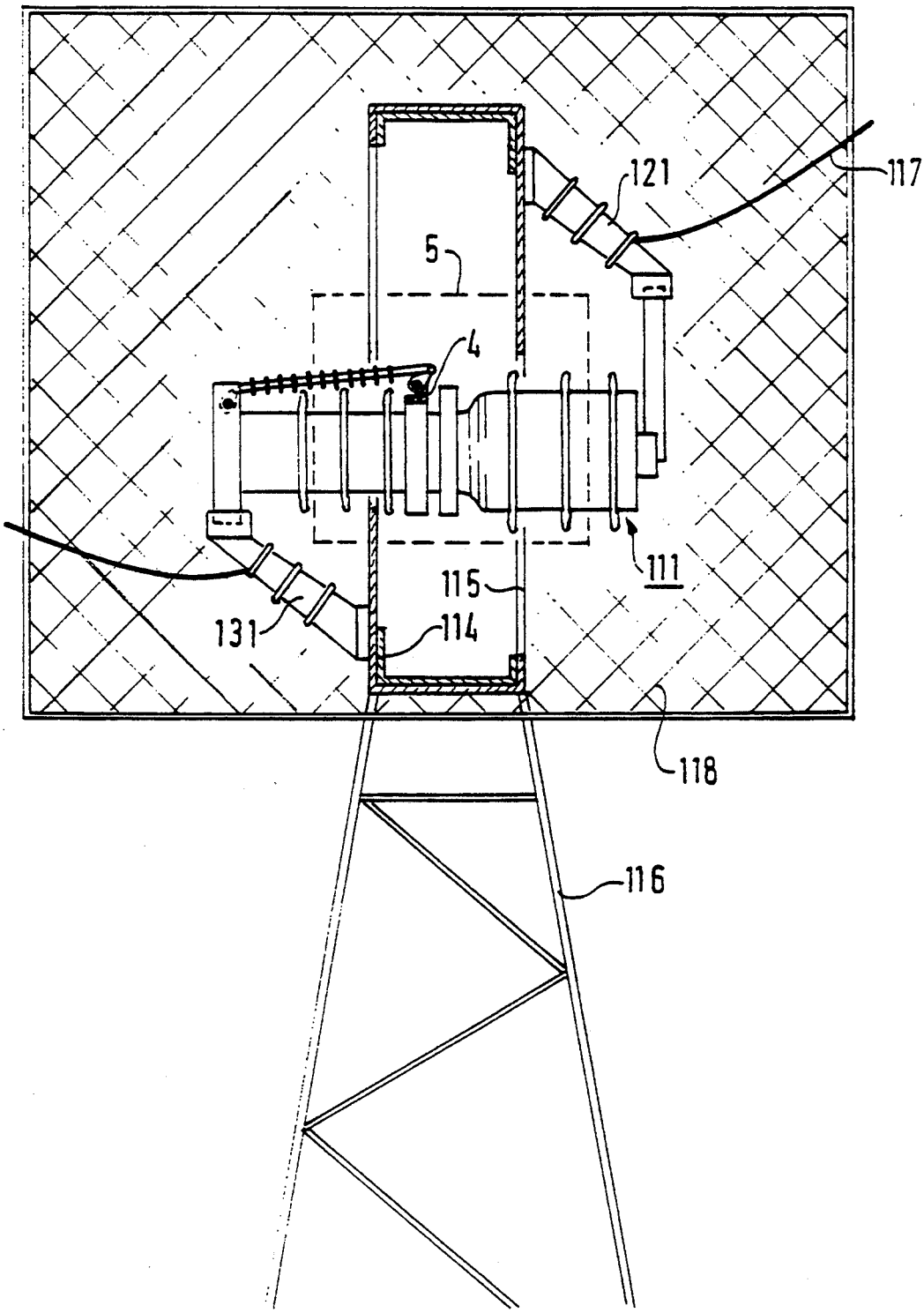
FIG. 12 is a diagrammatic front view of an outdoor circuit-breaker made using poles of the invention and organized to act as a section switch.
Figure 13:
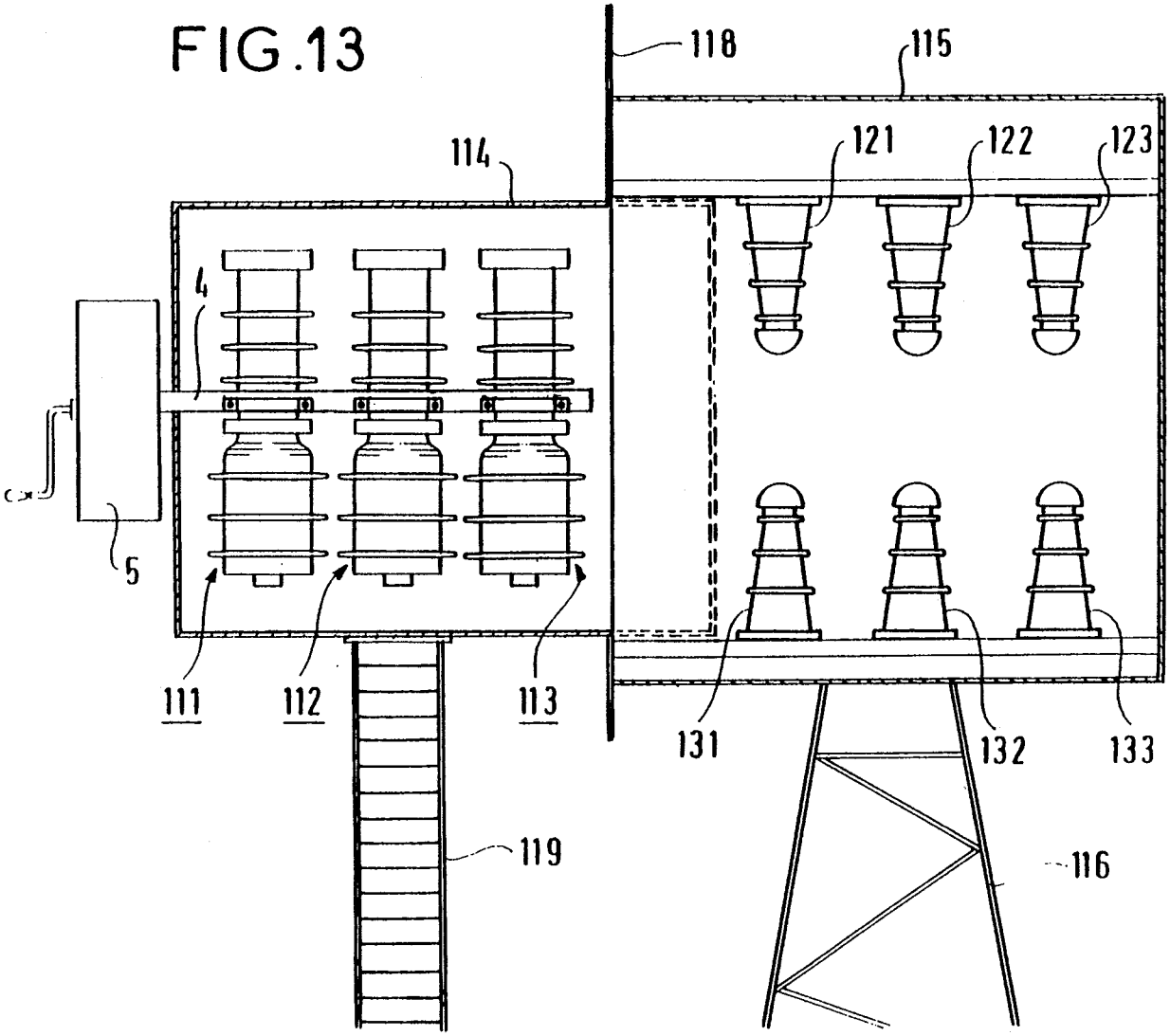
FIG. 13 is a side view on a smaller scale showing the circuit-breaker of the preceding figure, with the drawer containing the poles being pulled out.

FIGS. 12 and 13 show another application, namely that of a sectionable type circuit-breaker (also called a re-closer) for outdoor use.

The bar 4 supporting the poles 111, 112, and 113 is pivotally mounted in a drawer 114 capable of sliding in a frame 115 carried by a pylon 116. The control box is secured to the bar 4. The frame also carries insulating inlet supports 121, 122, and 123, and outlet supports 131, 132, and 133, for a line 117.

When the circuit-breaker is in the disengaged position, the bar 4 can be rotated about its own axis through 90°. The poles are then disconnected and contained inside the drawer 114. The drawer can then be pulled out in part (FIG. 13), thereby enabling visual inspection, maintenance, or replacement of one or more of the poles. A protective grid 118 serves to protect maintenance personnel who gain access to the drawer by means of a ladder 119.

Naturally, the invention is not limited to the embodiments or uses described above, and it is possible, in particular, to replace any means by equivalent means without going beyond the scope of the invention.

I claim:

1. A multi-pole medium-voltage circuit-breaker comprising one pole per phase, said circuit-breaker further comprising for each pole, an insulating feedthrough including a cylindrical first portion containing a vacuum bottle, said vacuum bottle comprising an insulating case closed by first and second metal endplates, the first metal endplate carrying a first terminal outside the case and a fixed contact inside the case, the second endplate having a moving metal rod passing therethrough in sealed manner and carrying a moving contact, the second endplate being electrically connected to said moving rod, the insulating feedthrough further including a second cylindrical portion having a metal tube disposed coaxially therein, said metal tube being mechanically connected to the vacuum bottle and electrically connected to said moving rod, said metal tube comprising a drive rod connected to said moving metal rod, the insulating feedthroughs of the poles being fixed to a common metal bar disposed substantially at the junction between the first and second portions of each feedthrough, said bar containing a control shaft common to the poles and connected to a drive mechanism, the drive rod of each pole being mechanically connected to said shaft by means of a lever hinged on an endpiece that is secured to the metal tube, and an insulating arm having a first end hinged to said lever and having a second end hinged to a crank secured to said shaft, said endpiece being mechanically and electrically connected to said metal tube and constituting a second terminal of the pole.

2. A circuit-breaker according to claim 1, wherein the first portion of said insulating feedthrough includes inside grooves that are parallel with the axis of the feedthrough and that cooperate with the outside wall of the vacuum bottle to define ventilation channels so that air flowing through said metal tube penetrates into said channels via holes in said tube.

3. A circuit-breaker according to claim 1, wherein the control shaft is a rotary shaft.

4. A circuit-breaker according to claim 1, wherein the control shaft is a shaft which is moved in translation along its own axis.

5. A circuit-breaker according to claim 1, wherein the vacuum bottle is placed in a cylindrical cage made of resin disposed inside said first portion of the feedthrough.

6. A circuit-breaker according to claim 5, wherein said resin cage includes inside grooves parallel to its axis and cooperating with the wall of the vacuum bottle to define ventilation channels, the air flowing in the metal tube penetrating into said channels via holes in said tube.

7. A circuit-breaker according to claim 6, wherein said sheath is made of latex.

8. A circuit-breaker according to claim 1, wherein the dielectric strength between said metal tube and said second portion of the insulating feedthrough is provided by a sheath of insulating material slid over said metal tube and engaged in said second portion, assembly being facilitated by using an insulating grease.

9. A circuit-breaker according to claim 1, wherein the moving parts between said control rod and said control shaft include a sprung backlash take-up mechanism.

10. A circuit-breaker according to claim 1, wherein the end of the drive rod includes a tubular end portion in which said moving rod is engaged, said moving rod having a slot in which a first pin is engaged, said first pin passing through said control rod, a spring bearing against a first thrust washer in contact with said end of the drive rod, and against a second thrust washer engaged in the moving rod and held by a second pin passing through the moving rod.

11. A circuit-breaker according to claim 1, wherein the mechanical connection between said metal tube and the vacuum bottle, and the electrical connection between said metal tube and said moving contact rod are provided by means of a sleeve fixed to said second endplate, a first ring secured to said sleeve and to said tube, and a second ring or concertina-type contact disposed inside said first ring and surrounding said moving contact rod.

12. A circuit-breaker according to claim 1, wherein the moving rod is screwed to the drive rod, and wherein electrical contact between said moving rod and the metal tube is provided by means of a set of contact springs.

13. A circuit-breaker according to claim 12, wherein the insulating case is molded over the metal tube.

14. A circuit-breaker according to claim 1, wherein said endpiece comprises two half-collars clamped on said metal tube and in abutment against the end of said second portion of the insulating feedthrough.

15. A circuit-breaker according to claim 14, wherein the halfcollars include studs engagable with recesses formed in said second portion of the insulating feedthrough to prevent said metal tube from rotating.

16. A circuit-breaker according to claim 1, wherein a coil having a toroidal metal core surrounds said second portion of the insulating feedthrough, level with a throat interconnecting said first and second portions of the insulating feedthrough.

17. A circuit-breaker according to claim 1, wherein the poles and the control box are fixed to a moving chassis, the poles of the circuit breaker being disposed to enable front plugging-in, and said control shaft for the poles being connected to the control box via a linkage.

18. A circuit-breaker according to claim 1, wherein said shaft is directly engaged with the control box secured to said bar, said bar is carried by a chassis, and the poles of the circuit-breaker being organized to enable end-on coupling.

19. A circuit-breaker according to claim 1, suitable for outdoor installation, wherein the common bar supporting the poles and containing the common drive shaft is carried by a gantry or by a bracket, the control mechanism contained in the control box placed in the vicinity of the ground being connected to said drive shaft by means of a rod and an angle take-off.

20. A circuit-breaker according to claim 19, wherein each of the poles is surmounted by a protective cap preventing rain penetrating therein but allowing the vacuum bottle to be ventilated.

* * * * *